US012796835B2

(12) United States Patent
Dorton et al.

(10) Patent No.: US 12,796,835 B2
(45) Date of Patent: Nov. 17, 2026

(54) PRONE POSITIONING DEVICE FOR A BABY

(71) Applicant: The Children's Mercy Hospital, Kansas City, MO (US)

(72) Inventors: Brandi Dorton, Kansas City, MO (US); Ricole Shafer, Kansas City, MO (US); Jessica Weight, Kansas City, MO (US); Stephanie Orr, Kansas City, MO (US)

(73) Assignee: The Children's Mercy Hospital, Kansas City, MO (US)

( * ) Notice: Subject to any disclaimer, the term of this patent is extended or adjusted under 35 U.S.C. 154(b) by 0 days.

(21) Appl. No.: 18/806,096

(22) Filed: Aug. 15, 2024

(65) Prior Publication Data

US 2025/0057333 A1 Feb. 20, 2025

Related U.S. Application Data

(60) Provisional application No. 63/520,149, filed on Aug. 17, 2023.

(51) Int. Cl.
*A47D 13/08* (2006.01)

(52) U.S. Cl.
CPC ..... *A47D 13/08* (2013.01)

(58) Field of Classification Search
CPC ..... A47D 13/08; A47D 7/00; A47D 15/005; A47D 15/008
See application file for complete search history.

(56) References Cited

U.S. PATENT DOCUMENTS 4,207,879 A * 6/1980 Safadago ..... A61G 7/10 482/145
4,354,485 A * 10/1982 Safadago ..... A61G 13/009 606/242

(Continued)

FOREIGN PATENT DOCUMENTS

CA 2280568 A1 * 2/2000 ..... A61G 5/1094
CN 111803301 A * 10/2020 ..... A61G 7/072

(Continued)

*Primary Examiner* — David E Sosnowski
(74) *Attorney, Agent, or Firm* — Hovey Williams LLP

(57) ABSTRACT

A prone positioning device is provided for a baby. A main body of the device includes a recess extending into a central support region from a front end toward a rear end of the main body. The recess is constructed for accommodating a tracheostomy tube in a baby supported on the central support region. A head rest is positionable in a supported position spaced forwardly from the front end of the main body for supporting a head of baby while supported on the central support region. A groin support extends upwardly from the central support region and is configured for placement between legs and against a groin of a baby supported on the central support region. The groin support may be positionable at multiple spaced apart locations along a longitudinal midline of the central support region to accommodate babies of different heights. At least one adjustable support is extendable downwardly below a base of the main body for elevating the central support region at the front end of the main body above or further above the central support region at the rear end of the main body.

24 Claims, 17 Drawing Sheets

(56) References Cited

U.S. PATENT DOCUMENTS 5,440,770 A * 8/1995 Nichols ..... A47D 15/008 5/655
5,524,640 A * 6/1996 Lisak ..... A61F 5/0193 5/655
5,652,981 A * 8/1997 Singer-Leyton ..... A47C 20/026 5/657
7,716,764 B2 * 5/2010 Joe ..... A47D 15/008 5/655
8,028,361 B2 * 10/2011 Ramer ..... A47D 15/008 128/845
8,584,280 B2 * 11/2013 Shah ..... A61G 13/122 5/655
8,607,386 B2 12/2013 Daly et al.
8,763,177 B2 * 7/2014 Shah ..... A61G 13/123 5/655
10,517,409 B1 * 12/2019 Shoup ..... A47D 15/008
2002/0113469 A1 * 8/2002 Stern ..... A47D 1/10 297/256.16
2002/0133881 A1 9/2002 Vrbas et al.
2005/0028286 A1 * 2/2005 Smart ..... A61F 5/3784 5/655
2008/0092300 A1 * 4/2008 Joe ..... A47D 15/008 5/655
2008/0178387 A1 * 7/2008 Kachtick-Anders ... A47D 13/08 5/655
2009/0178202 A1 * 7/2009 Kovalyak ..... A47D 15/008 5/655
2011/0041251 A1 * 2/2011 Ramer ..... A47D 13/08 5/655
2012/0036635 A1 * 2/2012 Lapointe ..... A47D 9/057 5/105
2024/0115451 A1 * 4/2024 Murdoch ..... A61G 13/121

FOREIGN PATENT DOCUMENTS

CN 112618232 A * 4/2021 ..... A61B 90/14
CN 118319629 A * 7/2024 ..... A61G 7/0526
CN 120420170 A * 8/2025 ..... A61G 7/0755

* cited by examiner

PRONE POSITIONING DEVICE FOR A BABY

CROSS-REFERENCE TO RELATED APPLICATION

This application claims the benefit of U.S. Provisional Patent Application No. 63/520,149, filed Aug. 17, 2023, entitled Prone Positioning Device for a Baby, which is incorporated by reference herein in its entirety.

BACKGROUND

The present disclosure relates generally to support devices for babies and, more specifically, to support devices for positioning babies in a prone or facedown position.

Pediatric medical specialists generally recommend that parents initiate tummy time for their newborn babies on the first day they are home from the hospital and gradually increase the amount of tummy time as the baby grows older and stronger. Time spent by the baby while lying on their stomach is important for the physical growth and strengthening of the baby's bones, muscles, and ability to move and touch their surroundings. For example, tummy time aids in speech production and safe swallowing by facilitating the development of the movement and coordination of the lips, tongue, jaw, and palates. Other specific benefits include the development of binocular vision and laying the groundwork for the gross motor skill progression of rolling, crawling, balance and climbing. Tummy time also reduces the opportunity for the development of the flattening of the baby's skull, a condition known as brachycephaly.

Premature or sick babies who are unable to breathe well enough on their own may require breathing assistance from a mechanical ventilator that is attached to a breathing tube that is inserted through the mouth and into the trachea of the baby. Some babies may subsequently or alternatively require a tracheostomy procedure in which a tracheostomy tube is surgically inserted through the neck into the trachea to allow sufficient air to pass into and from the lungs. Normally, the tracheostomy tube is connected to a mechanical ventilator. The need for a tracheostomy may be the result of various medical conditions, such as airway blockages, congenital defects that limit airflow, and neurological impairments that inhibit normal breathing.

Babies who are provided with breathing assistance from a mechanical ventilator often spend limited tummy time, and thus experience delayed developmental milestones, because of the interference of the breathing tube or a tracheostomy tube with the support surface. While various devices are available that are intended to place and support babies in a prone position, they lack a combination of features specially designed for babies who have limited head control and have medical tubes attached, such as a breathing or tracheostomy tube.

BRIEF DESCRIPTION

This brief description is provided to introduce a selection of concepts in a simplified form that are further described in the detailed description below. This brief description is not intended to identify key features or essential features of the claimed subject matter, nor is it intended to be used to limit the scope of the claimed subject matter. Other aspects and advantages of the present disclosure will be apparent from the following detailed description of the embodiments and the accompanying drawing figures.

In one aspect, the present disclosure is directed to a prone positioning device comprising a main body and an optional head rest. The optional head rest is spaced forwardly from the front end of the main body and is positionable for supporting the head of a baby, when the baby is supported on a central support region of the device's main body. The main body comprises spaced apart front and rear ends, spaced apart sides, and a base for supporting the main body on a surface. The central support region extends between the front and rear ends of the main body for supporting at least a torso of a baby. The device further includes a recess extending into the central support region from the front end toward the rear end of the main body and constructed for accommodating one or more medical tubes in a baby supported on the central support region.

In another aspect, the present disclosure is directed to a prone positioning device for a baby comprising a main body and an optional adjustable head rest. The optional head rest is positionable in multiple supported positions and is spaced forwardly from a front end of a main body in a plane above a central support region. The head rest is configured to support a head of a baby, when the baby is supported on the central support region of the main body. The main body comprises spaced apart front and rear ends, spaced apart sides, and a base for supporting the main body on a surface. The central support region extends between and slopes downwardly from the front toward the rear end of the main body for supporting at least a torso of a baby. Sidewalls extend upwardly above the central support region at the spaced apart sides for sideways confining a baby within the central support region. A recess extends into the central support region from the front end toward the rear end of the main body and is constructed for accommodating one or more medical tubes a baby, when the baby is supported on the central support region.

In a further aspect, the present disclosure is directed to a prone positioning device for a baby comprising a main body having: spaced apart front and rear ends; spaced apart sides; a base for supporting the main body on a surface; a central support region extending between and sloping downwardly from the front toward the rear end of the main body for supporting at least a torso of a baby; sidewalls extending upwardly above the central support region at the spaced apart sides for sideways confining a baby within the central support region; and a recess extending into the central support region from the front end toward the rear end of the main body and constructed for accommodating one or more medical tubes in a baby supported on the central support region. The prone positioning device further includes: a groin support extending upwardly from the central support region and configured for placement between legs and against a groin of a baby supported on the central support region, said groin support being positionable at multiple spaced apart locations along a longitudinal midline of the central support region; a strap carried by the main body for extending over and retaining a baby on the central support region; a tray extending outwardly from the front end of the main body and positioned in a plane below the head rest; and at least one adjustable support extendable downwardly at multiple positions below the base of the main body for elevating the central support region at the front end of the main body further above the central support region at the rear end of the main body.

BRIEF DESCRIPTION OF THE DRAWINGS

The present disclosure is described in detail below with referenced to the accompanying drawing figures, wherein.

DETAILED DESCRIPTION

Figure 1:
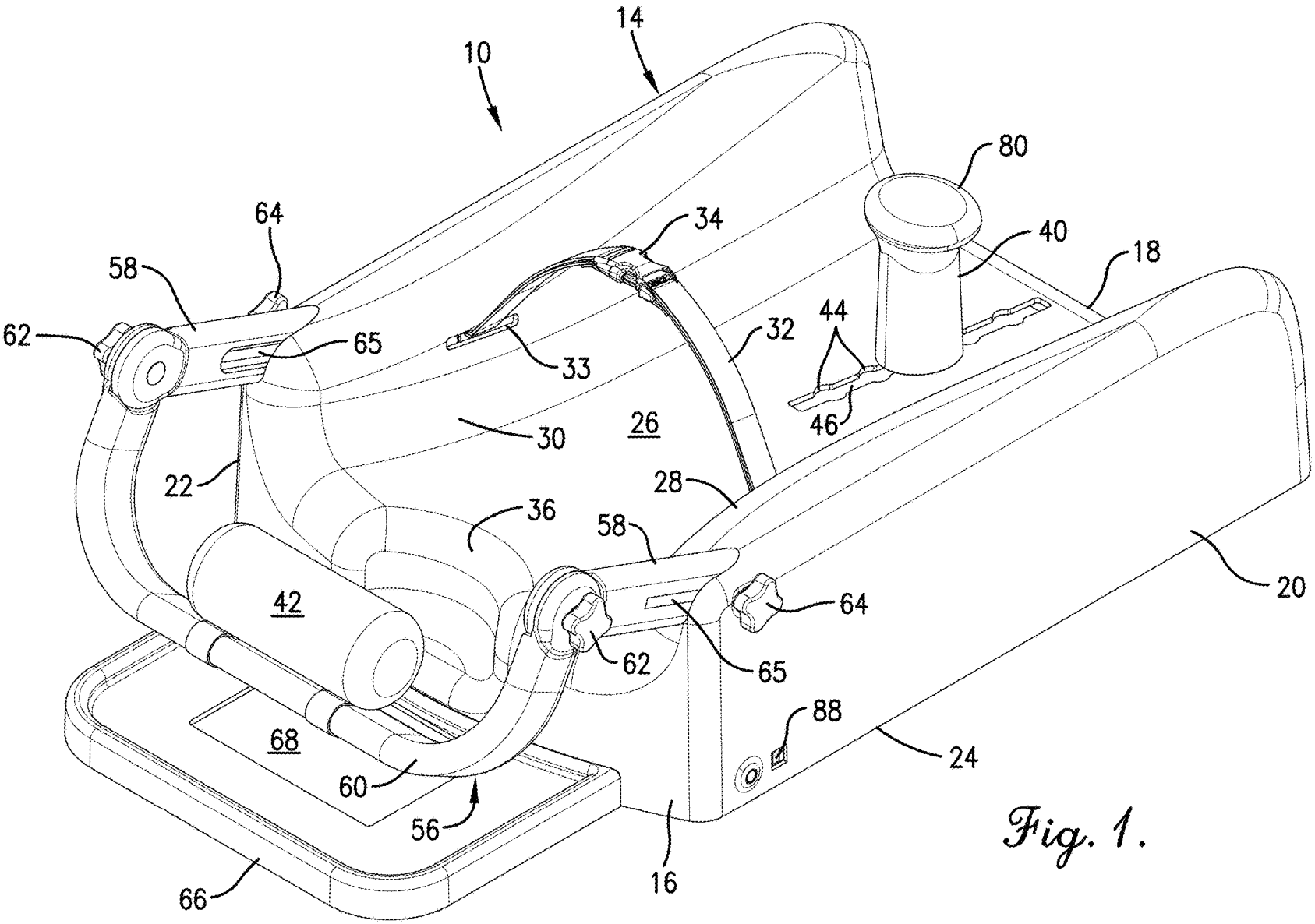
FIG. 1 is a top perspective view of a prone positioning device according to a first embodiment of the present disclosure.
Figure 2:
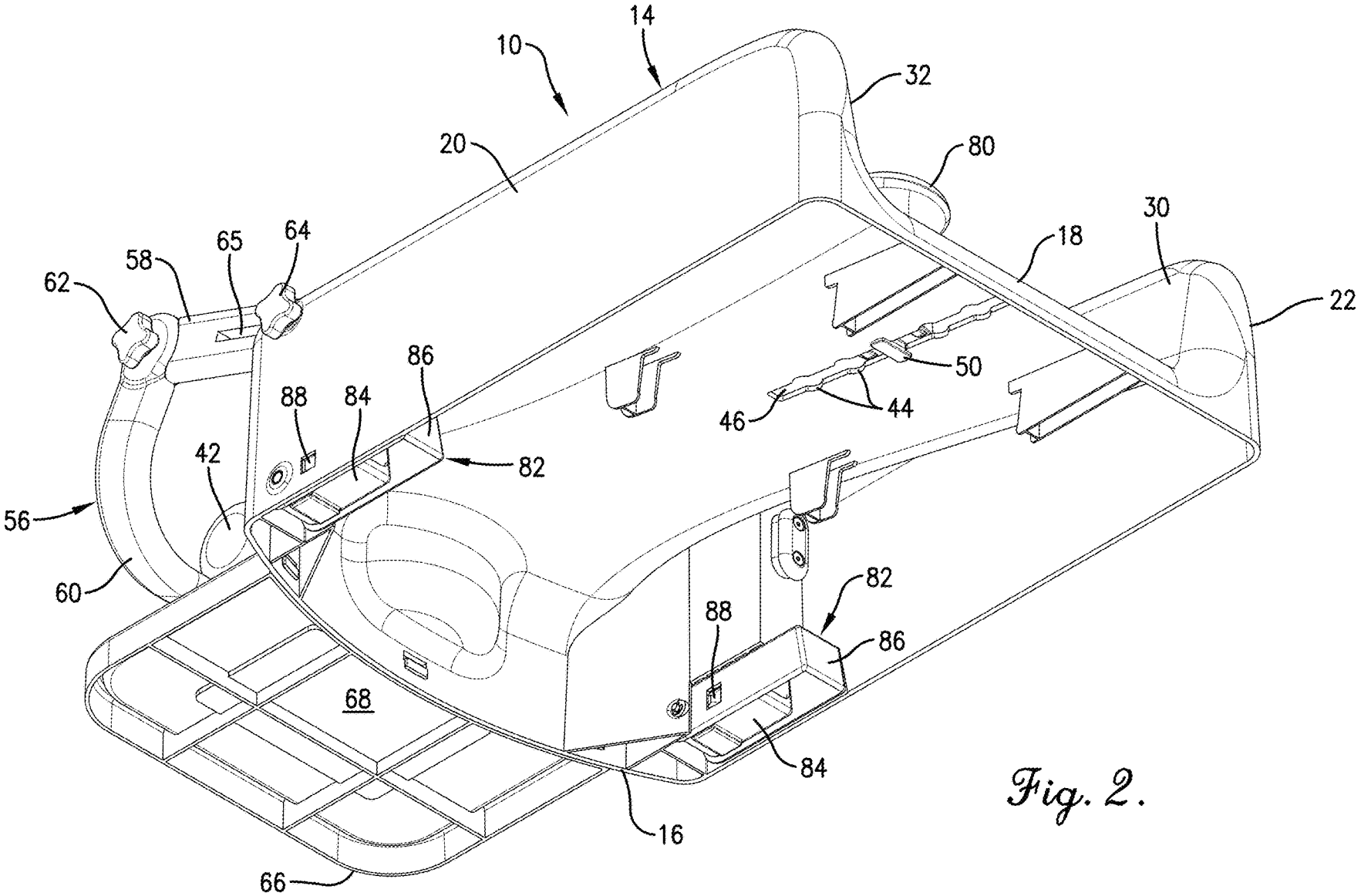
FIG. 2 is a bottom perspective view of the first embodiment of the prone positioning device.

The subject matter of the present disclosure is described herein to meet statutory requirements. However, the description itself is not intended to limit the scope of the claims. Rather, the inventors have contemplated that the claimed subject matter might also be embodied in other ways, to include different components, combinations of components, steps, or combinations of steps similar to the ones described herein, in conjunction with other present or future technologies.

Turning now to the drawings in greater detail and initially to FIGS. 1-9, a first embodiment of a prone positioning device is represented generally by the numeral 10 and is constructed for supporting a baby 12 (FIG. 3) in a prone or facedown position to facilitate the baby's development.

The prone positioning device 10 has a main body 14 with spaced apart front and rear ends 16 and 18, respectively, and spaced apart sides 20 and 22 respectively. The main body 14 further includes a base 24 for supporting the main body 14 on a surface. The base 24 may be in the form of a bottom peripheral edge of the front and rear ends 16 and 18 and the sides 20 and 22 of the main body 14.

Figure 3:
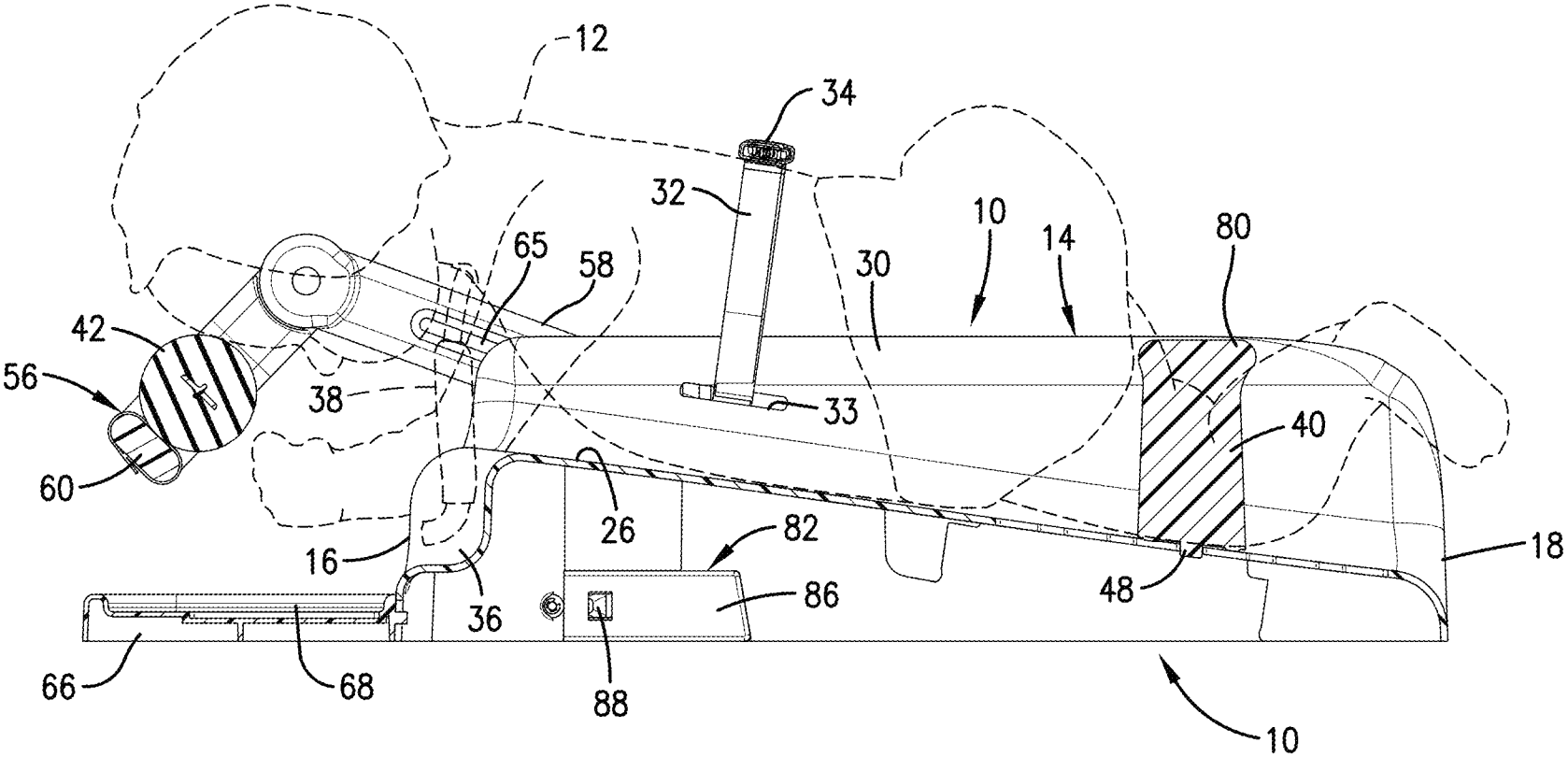
FIG. 3 is a side elevation view of the first embodiment of the prone positioning device, taken in vertical section along a longitudinal midline and showing a representation of a baby supported on the prone positioning device.
Figure 4:
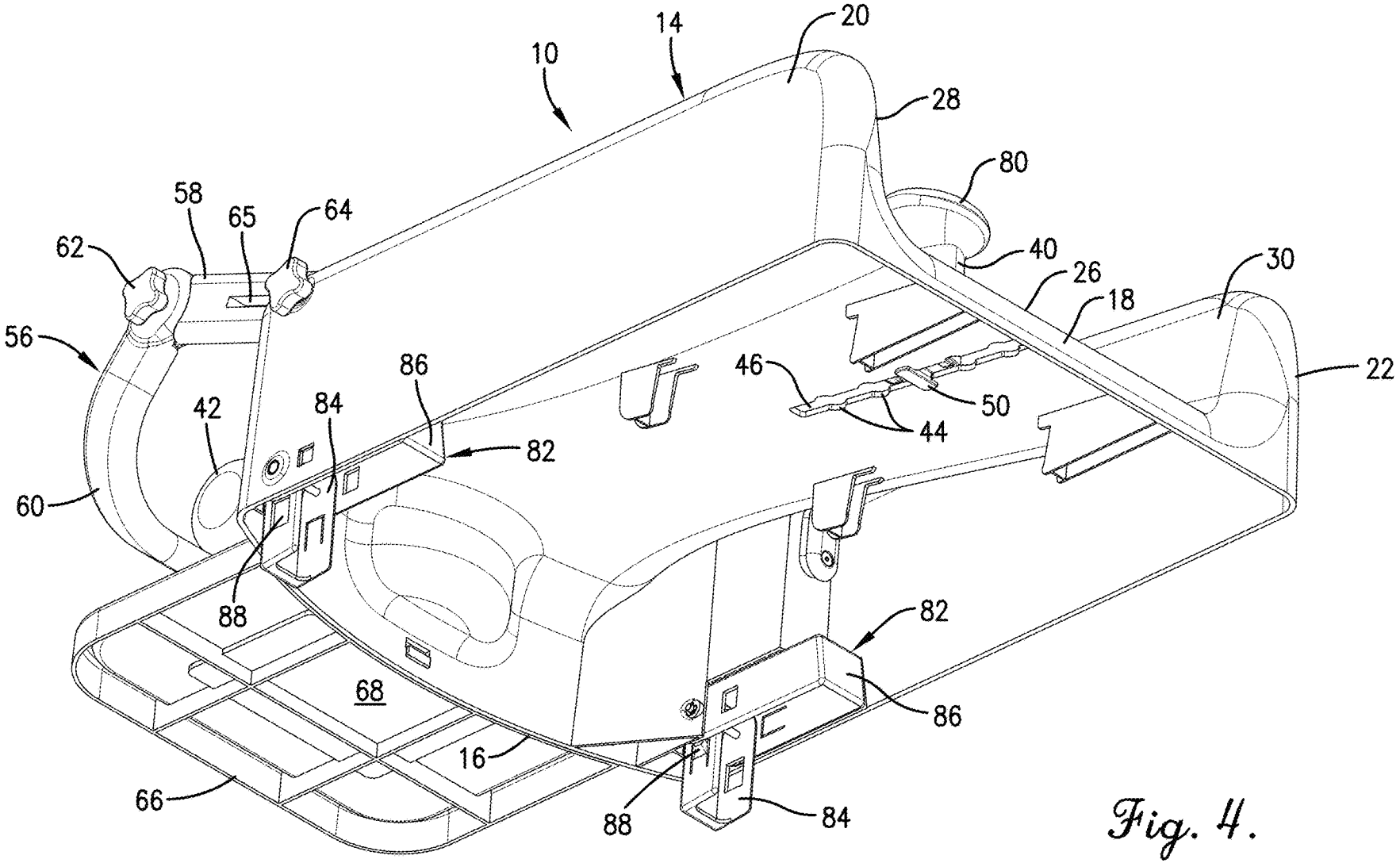
FIG. 4 is a bottom perspective view similar to that shown in FIG. 2 but showing supports deployed in a first position for placing the first embodiment of the prone positioning device in an elevated inclined position.
Figure 5:
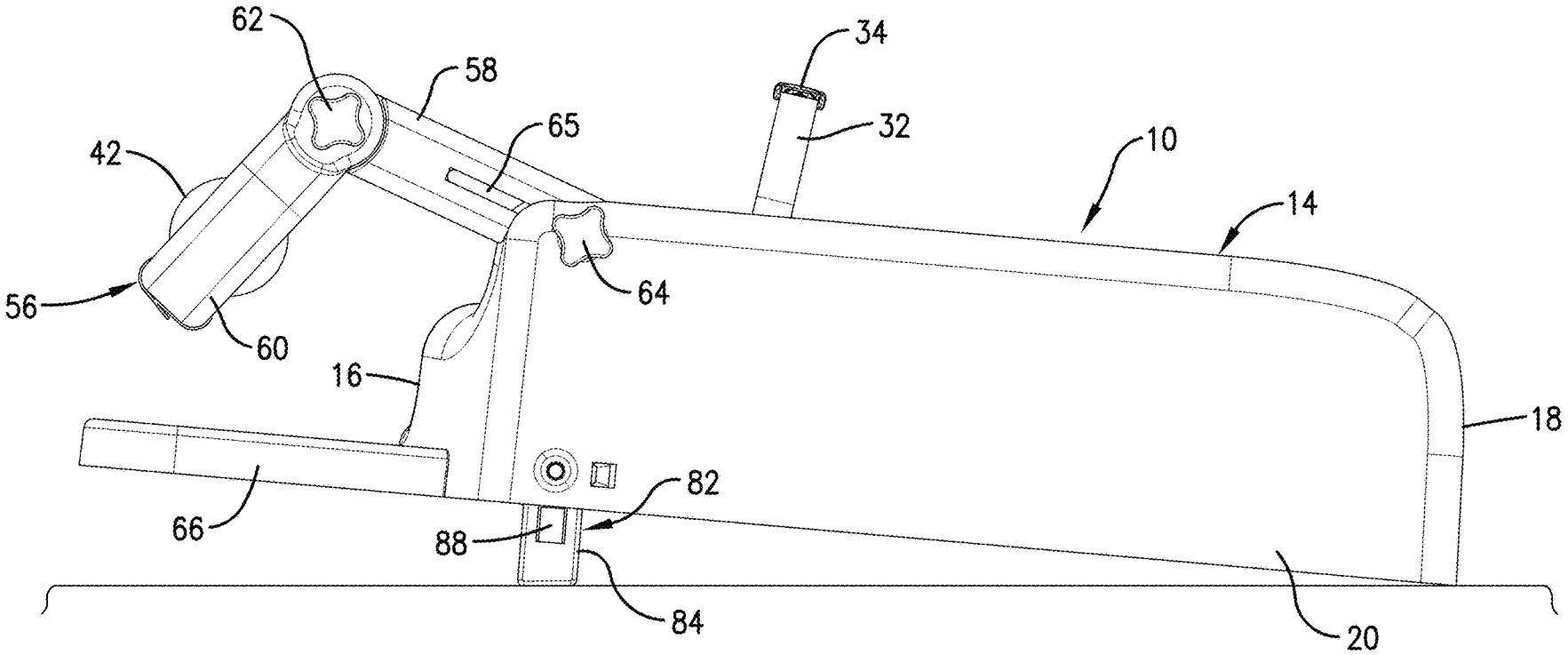
FIG. 5 is a side elevation view showing the first embodiment of the prone positioning device in the elevated inclined position.
Figure 6:
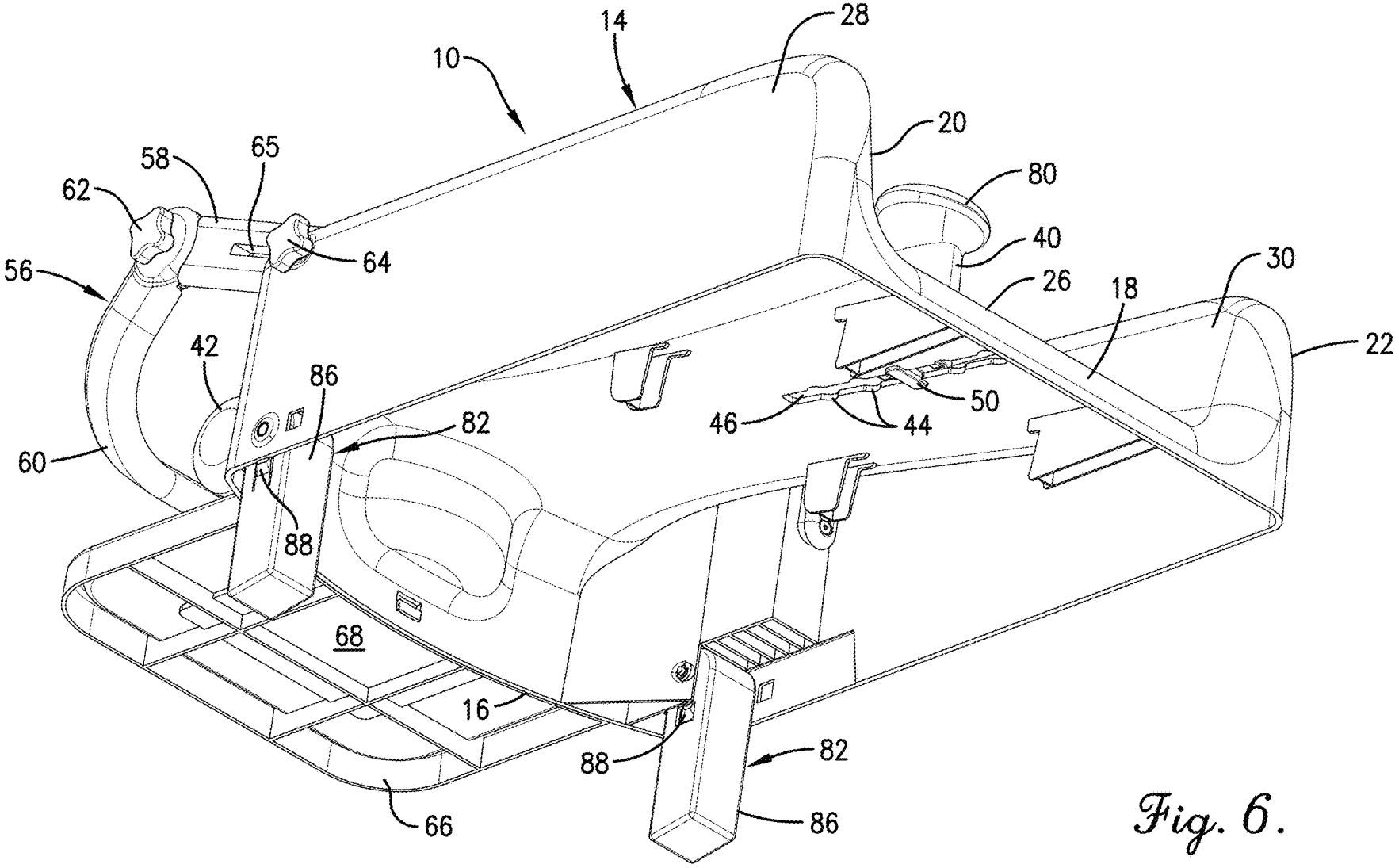
FIG. 6 is a bottom perspective view similar to that shown in FIG. 4 but showing the supports deployed in a second position for placing the first embodiment of the prone positioning device in a further elevated inclined position.
Figure 7:
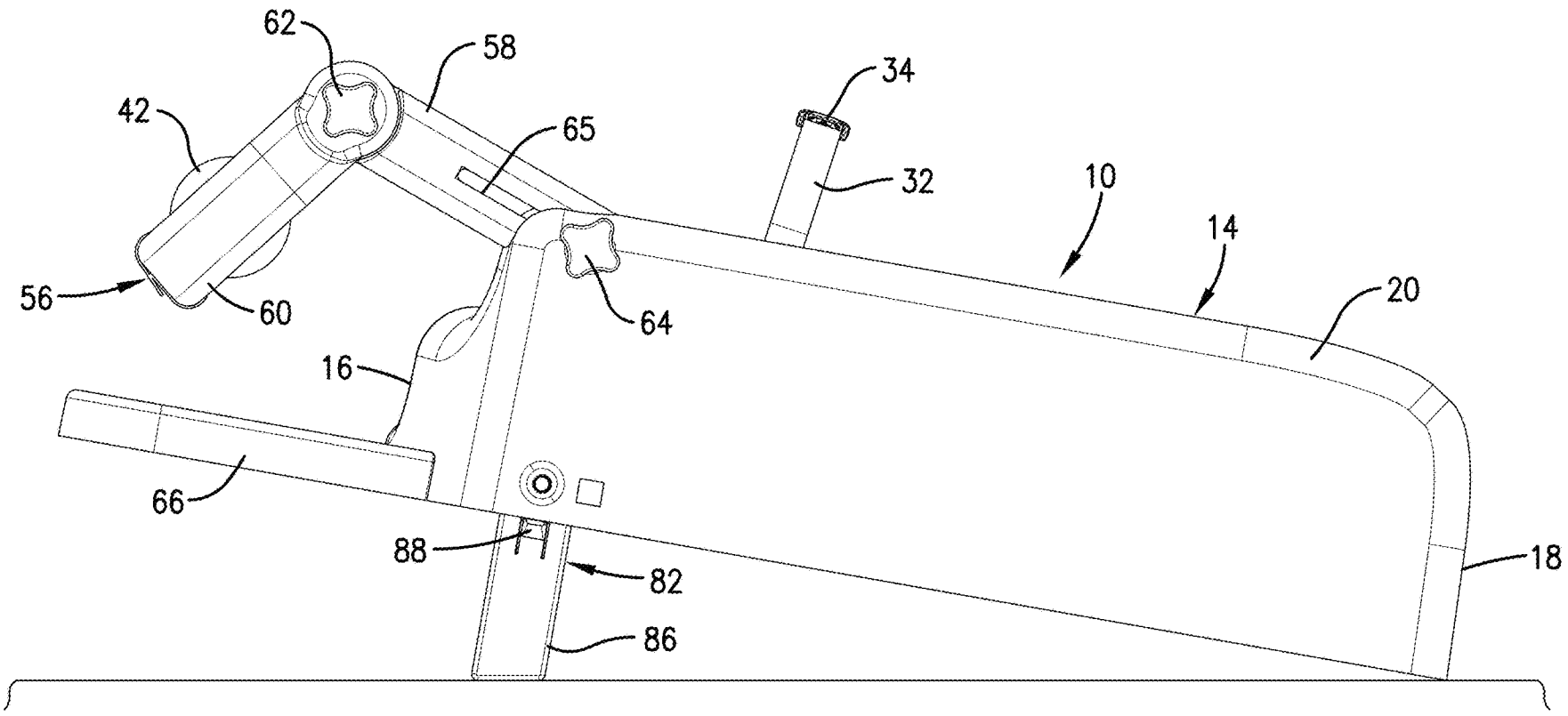
FIG. 7 is a side elevation view showing the first embodiment of the prone positioning device in the second inclined position.
Figure 8:
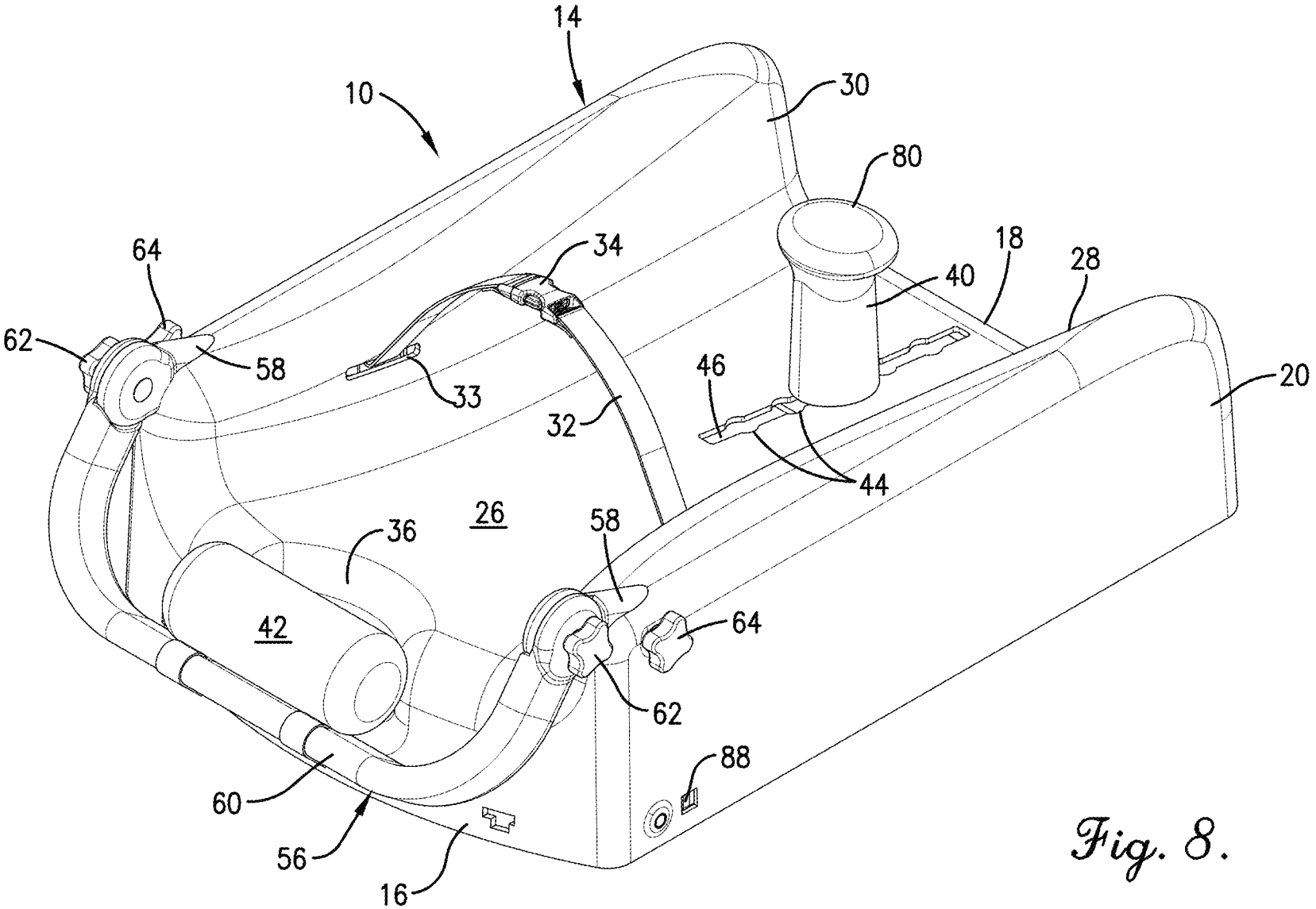
FIG. 8 is a top perspective view of the first embodiment of the prone positioning device with a tray removed and a head rest shown in a storage position.
Figure 9:
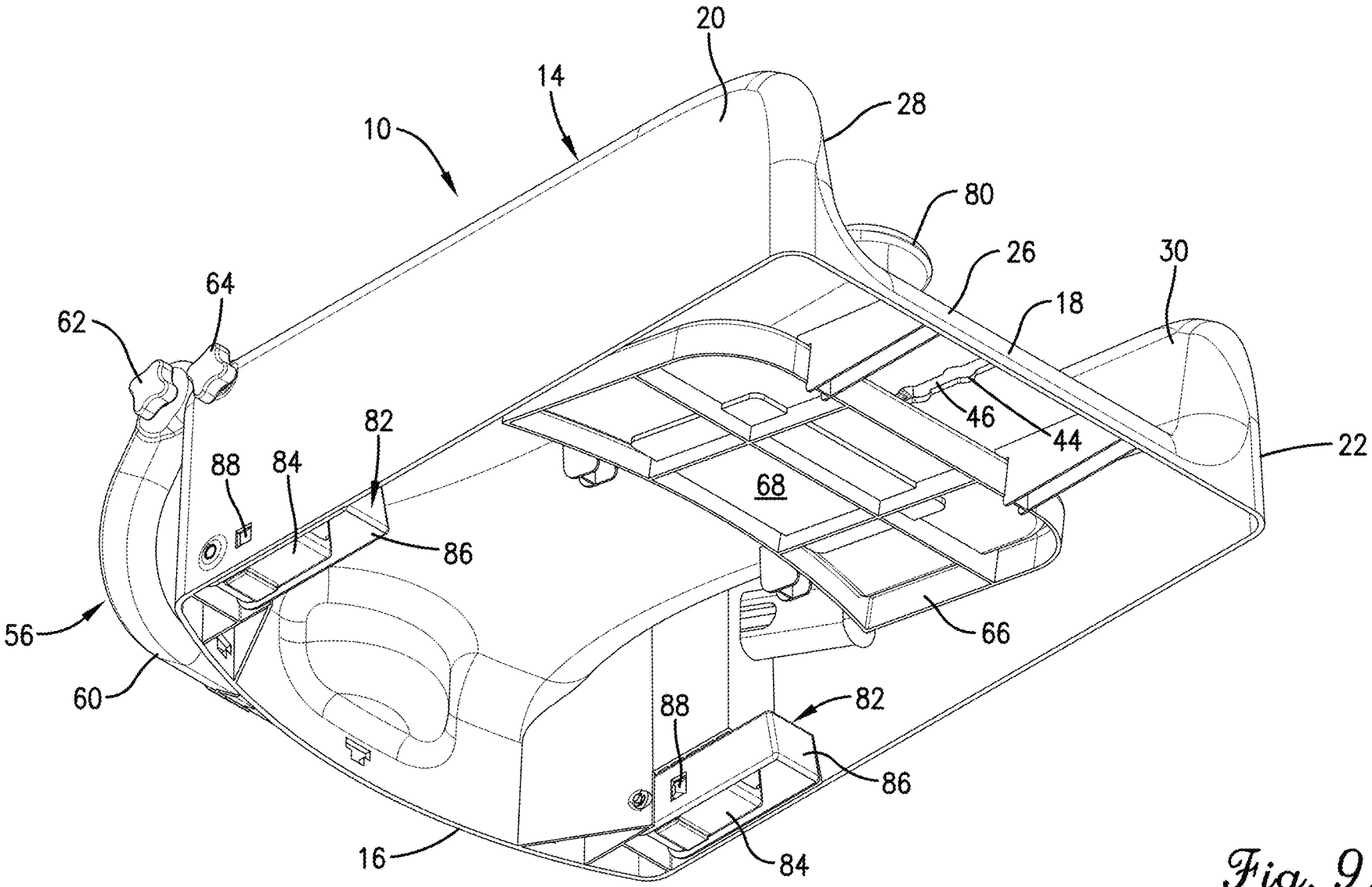
FIG. 9 is a bottom perspective view of the first embodiment of the prone positioning device and showing the tray secured in a storage position under a main body of the prone positioning device.
Figure 10:
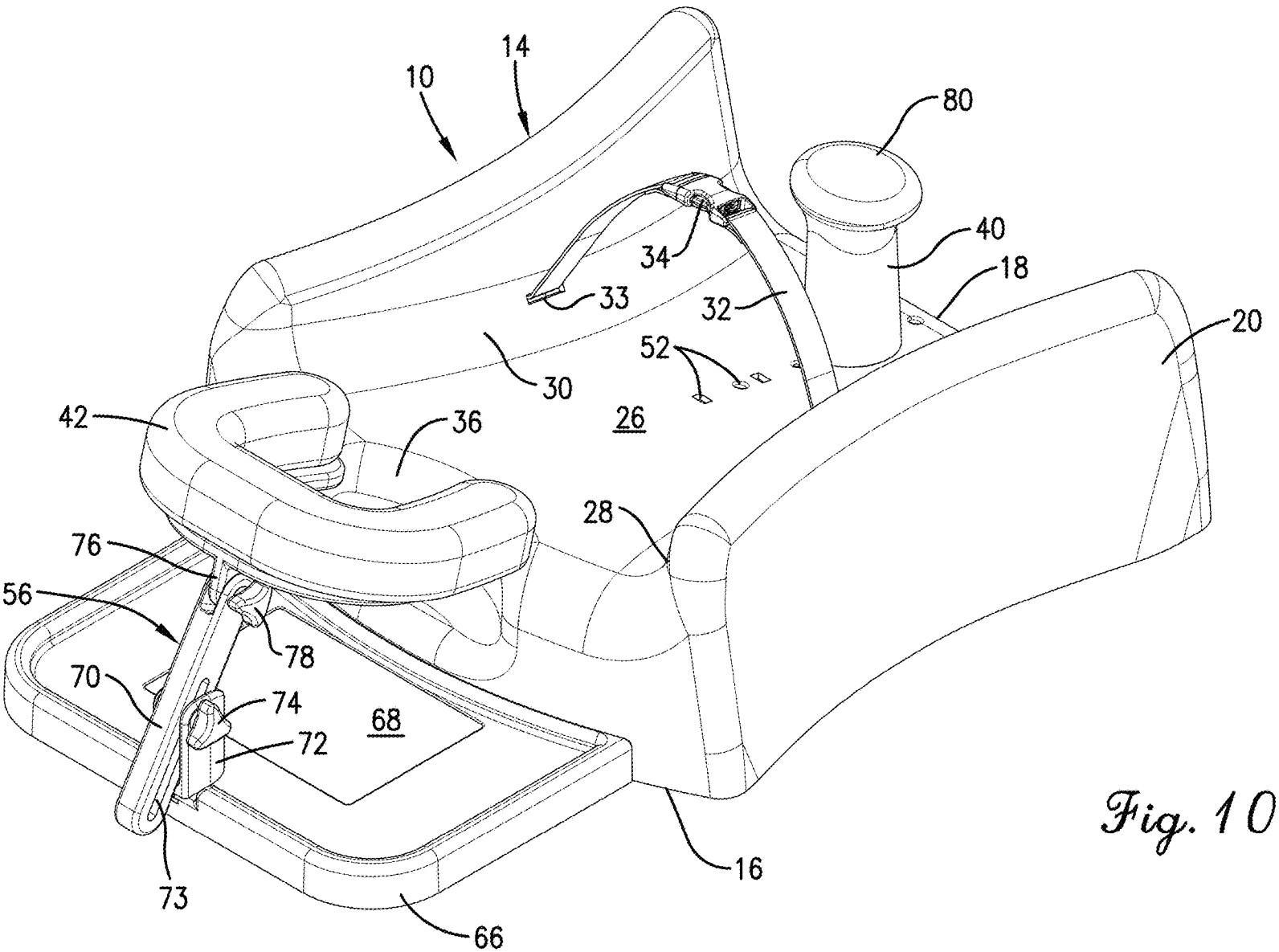
FIG. 10 is a top perspective view of a second embodiment of a prone positioning device of the present disclosure.
Figure 11:
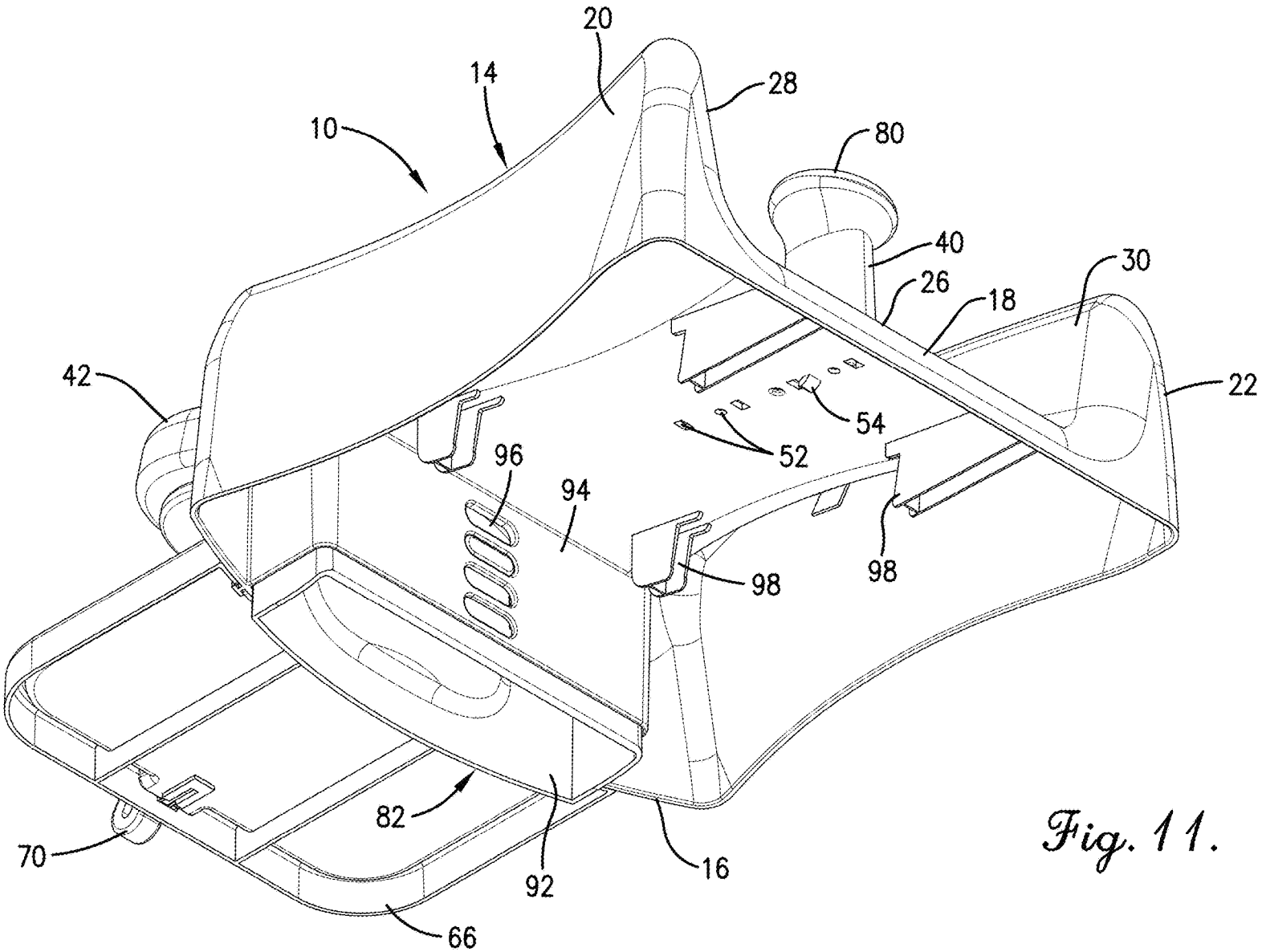
FIG. 11 is a bottom perspective view of the second embodiment of the prone positioning device.
Figure 12:
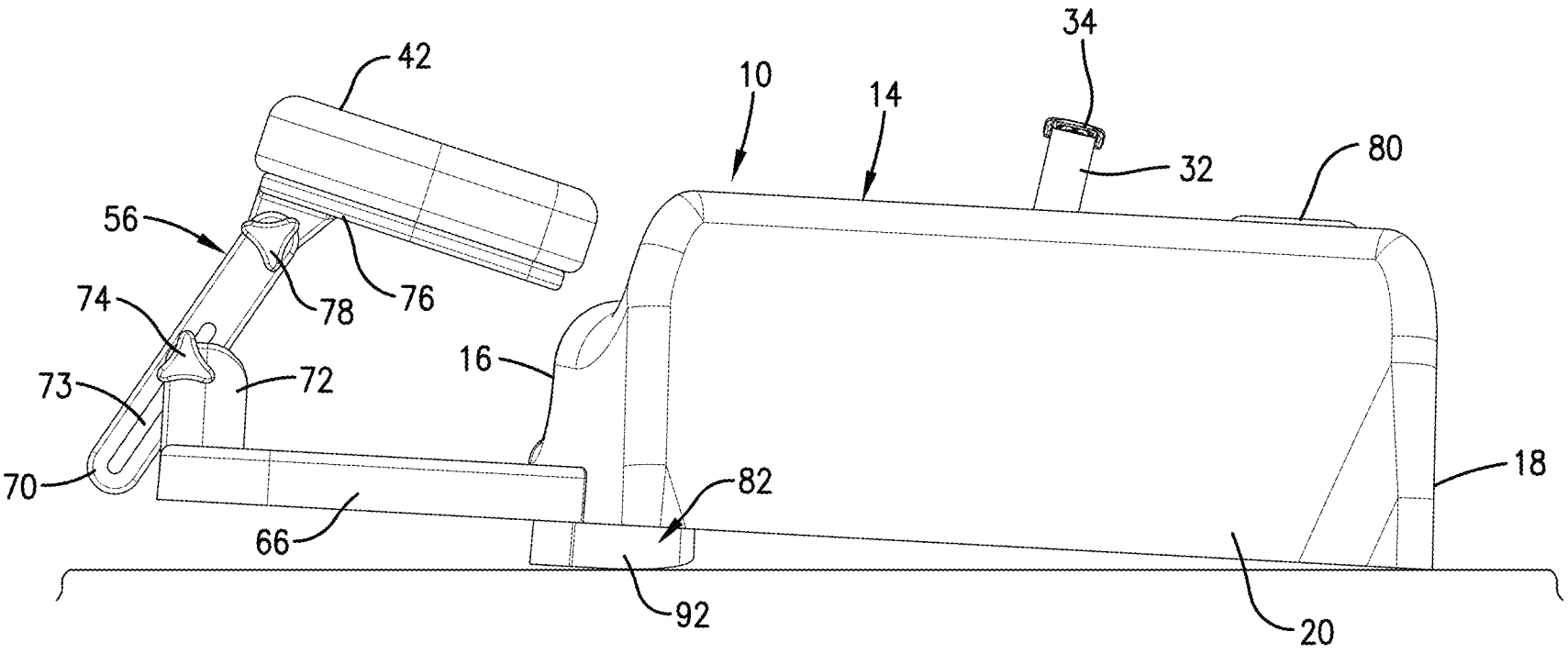
FIG. 12 is a side elevation view of the second embodiment of the prone positioning device.
Figure 13:
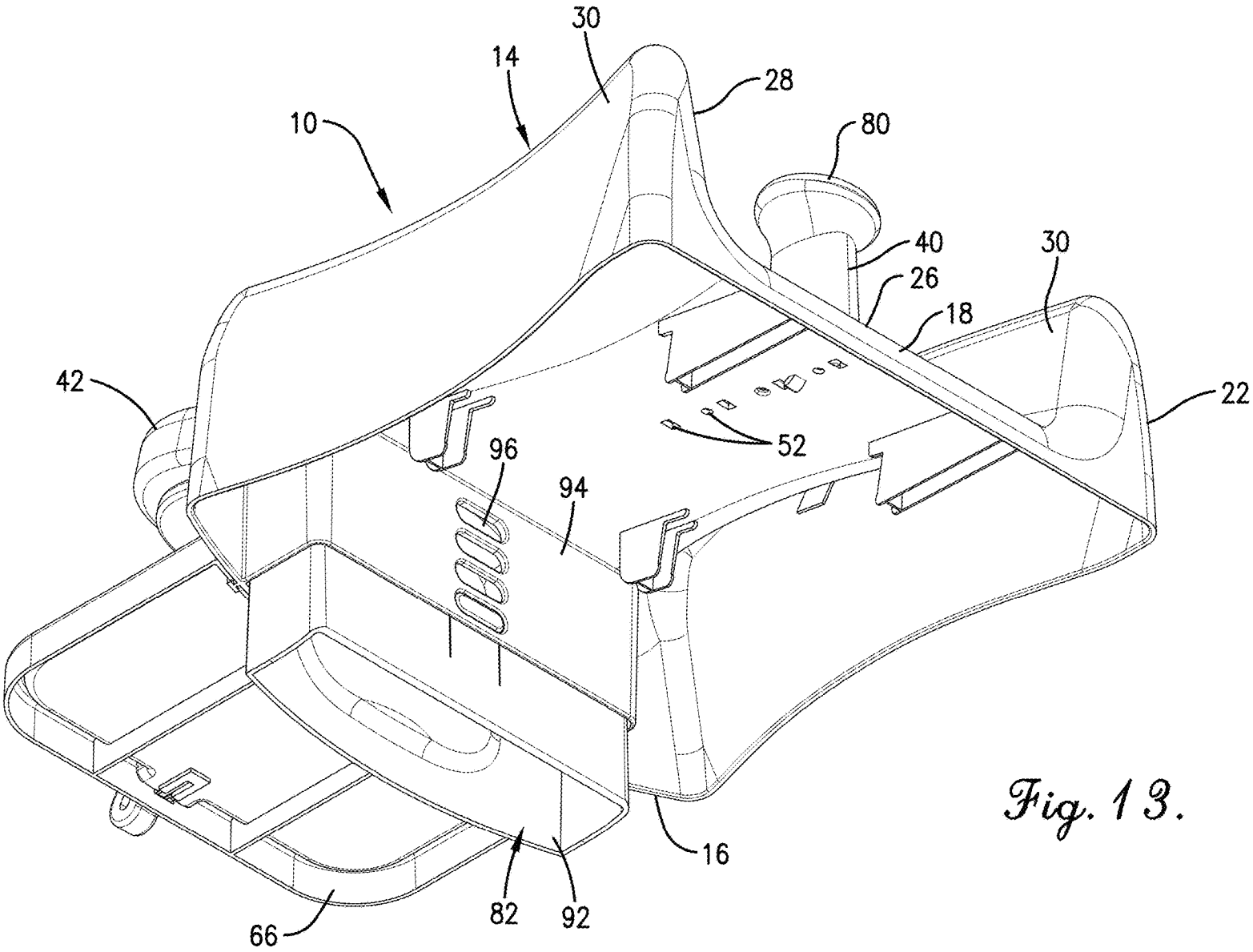
FIG. 13 is a bottom perspective view similar to that shown in FIG. 11 but showing a support deployed in a first position for placing the second embodiment of the prone positioning device in an elevated inclined position.
Figure 14:
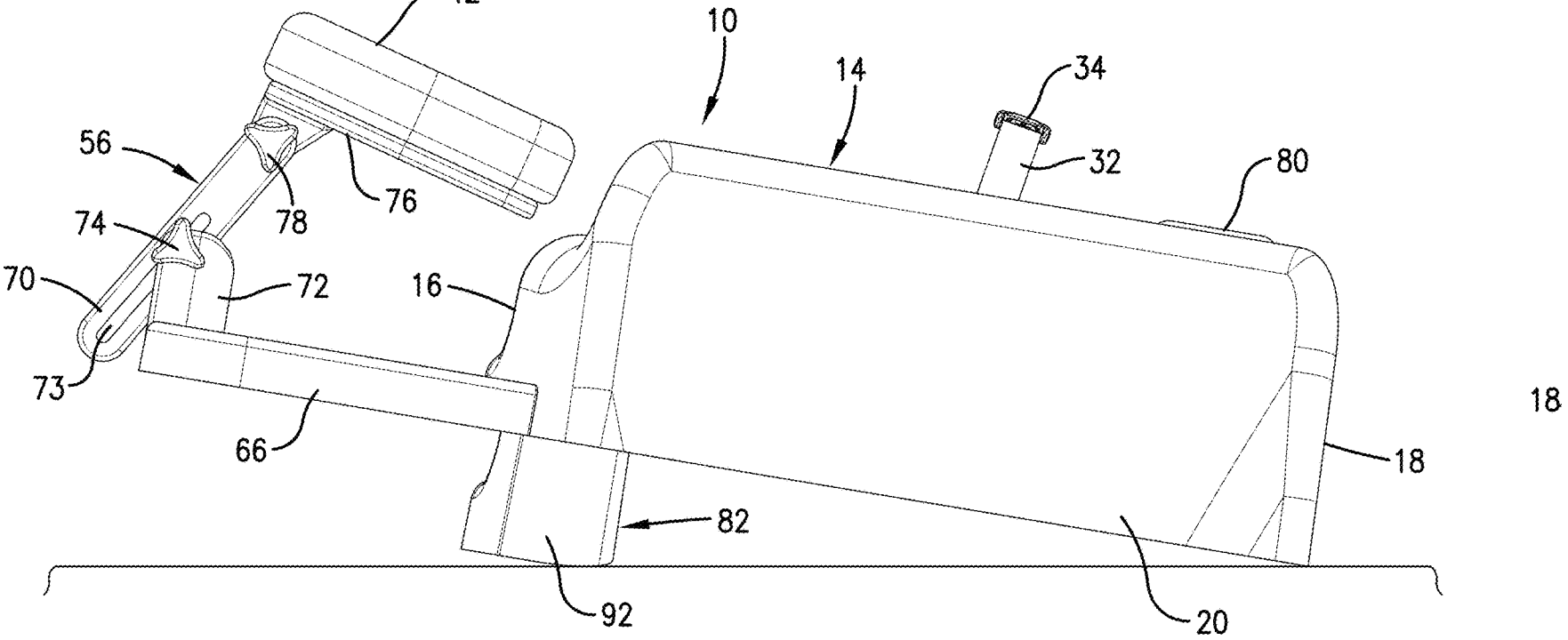
FIG. 14 is a side elevation view showing the second embodiment of the prone positioning device in the elevated inclined position.

The main body 14 includes an upwardly facing central support region 26 extending between the front end 16 and the rear end 18 of the main body 14 for supporting at least a torso of the baby. Depending on the relative sizes of the central support region 26 and the baby 12 (FIG. 3), the central support region 26 may additionally support a part or all of the legs of the baby 12. In FIG. 3, the central support region 24 is shown supporting the torso and as well as the legs of the baby 12. The central support region 26 may have a width that is designed to accommodate babies in a specific weight range and a length that is designed to accommodate babies have a specific height range.

The main body 14 can be configured to accommodate babies of different sizes and ages. In one embodiment, the main body 14 can be configured to accommodate babies from 2 to 12 months of age, a weight of 10 to 20 lbs, and a length of 22 to 30 inches. In such an embodiment, the main body 14 comprises a base 24 having a length of 18 inches. In an alternate embodiment, the main body 14 comprises a base 24 having a length of 24 inches and can accommodate babies of up to 2 years in age, having a weight of up to 34 lbs., and a length of up to 35 inches. It will be appreciated, though, that these configurations and dimensions are exemplary, and describe preferred configuration of device 10. Moreover, it is within the scope of the present invention to configure main body 14 to have an adjustable base length by being constructed from telescoping parts, for example, thus permitting device 10 to accommodate babies from 2 months to 2 years in age.

The central support region 26 may be bounded at its sides by sidewalls 28 and 30 that extend upwardly above the central support region 26 to sideways confine the baby 12 on the central support region 26. In one exemplification, the sidewalls 28 and 30 may be positioned at the sides 20 and 22 of the main body. A strap 32 may be provided to place over a back of the baby 12 to further confine the baby 12 on the central support region 26. The strap 32 may be associated with the sidewalls 28 and 30, such as by extending through slots 33 formed in the sidewalls 28, and may include a clasp 34 or other fastening means.

A recess 36 extends a preselected distance into the central support region 26 from the front end 16 toward the rear end 18 of the main body 14 of the prone positioning device 10. The recess 36 is constructed for accommodating one or more medical tubes, such as the illustrated tracheostomy tube 38 (FIG. 3) that has been inserted into the trachea of the baby 12. As used herein, the term "medical tube" refers to any tube or line that is attached to the baby's body and used to deliver treatment to the baby, including air, oxygen, medications, intravenous fluids, and the like; or tubes or lines that carry away fluids from the baby's body, such as surgical drains. Examples of medical tubes that recess 36 can accommodate include, but are not limited to, gastronomy tubes (G-tubes), drain tubes, tracheostomy tubes, and PICC and MCC lines. The recess 36 allows the baby 12 with the tracheostomy tube 38 to be supported in a prone position on the central support region 26 with the baby's torso fully supported on the central support region 26 and the tracheostomy tube 38 extending downwardly into the recess 36. The recess 36 may be centered on a longitudinal center axis of the central support region 26 and has a width sufficient to accommodate sideways movement of the tracheostomy tube 38 resulting from movement of the baby 12.

In order to maintain the desired longitudinal positioning of the baby 12 on the central support region 26, a groin support 40 is provided that extends upwardly from the central support region 26 and is configured for placement between legs and against a groin of the baby 12 when supported on the central support region 26. A head rest 42 is also provided that may be positioned in a supported position spaced forwardly from the front end 16 of the main body 14 for supporting a head of the baby 12 when the torso of the baby 12 is supported on the central support region 26.

Both the groin support 40 and the head rest 42 may be adjustable to accommodate a specific height or other characteristics of the baby 12 that is being placed on the prone positioning device 10. For example, the groin support 40 may be positionable at multiple spaced apart locations along a longitudinal midline of the central support region 26. Similarly, the head rest 42 may be positioned at different elevations and at different distances from the front end 16 of the main body 14.

In the embodiment illustrated in FIGS. 1-9, a lower end of the groin support 40 may be inserted at any one of multiple spaced apart locations 44 within a longitudinal slot 46 that is formed in the central support region 26. The spaced apart locations 44 may be in the form of widened portions of the longitudinal slot 46 that receive a complementally sized and shaped extension 48 (FIG. 3) that extends downwardly from the lower end of the groin support 40. A locking tab 50 (FIG. 2) may be fixed to a lower end of the extension 48 and is sized and shaped to pass through the longitudinal slot 46 in one rotational orientation of the groin support 40 and then to engage against an undersurface of the central support region 26 adjacent the longitudinal slot 46 when the groin support 40 is rotated 90 degrees to a locking second orientation.

In another embodiment as illustrated in FIGS. 10-17, a plurality of spaced apart openings 52 may be provided along the longitudinal midline of the central support region 26 to receive spaced apart projections 54 that extend downwardly from the lower end of the groin support 40. At least one of the projections 54 is constructed to snap fit within one of the openings 52 and against the undersurface of the central support region 26 adjacent to the opening 52. The other projection 54 is received within another one of the openings 52 to prevent rotation of the groin support 40. Other ways of adjustably positioning the groin support 40 are possible and are within the scope of the claims.

The head rest 42 may be padded and may be carried by an adjustable frame 56 that allows for positioning of the head rest 42 at different elevations and at different distances from the front end 16 of the main body 14. In addition, the head rest 42 can be configured to accommodate a baby having a head circumference of up to 20 inches, from 14 to 20 inches, or from 15 to 18 inches, and a head weight of up to 15 lbs., from 5 to 15 lbs., or from 7 to 10 lbs.

In one embodiment illustrated in FIGS. 1-9, the adjustable frame 56 may include an arm 58 that extends forwardly from the sidewall 28 and another arm 58 that extends forwardly from the sidewall 30, and a U-shaped connecting arm 60 that is pivotally connected to forward ends of the arms 58. Knobs 62 positioned at the pivotal connections between arms 58 and the U-shaped connecting arm 60 may be loosened to allow for adjustment of the elevation and forward spacing of the U-shaped connecting arm 60 and the head rest 42 that is carried on the U-shaped connecting arm 60. Once the desired position of the head rest 42 is reached, the knobs 62 may be tightened to fix the head rest 42 in that position. The arms 58 may be mounted on the sidewalls 28 and 30 in a manner that allows for additional adjustment of the positioning of the head rest 42. For example, the arms 58 may extend forwardly along an incline and may be extended and retracted by loosening knobs 64 carried on a threaded rod (not shown) that extends through a slot 65 in each arm 58. The knobs 64 may then be tightened to prevent further movement of the arms 58 once the head rest 42 is in the desired position.

In another embodiment illustrated in FIGS. 10-17, the adjustable frame 56 is mounted at a forward end of a tray 66 that forms part of the prone positioning device 10. The tray 66 may be fixed or releaseably attached to the front end 16 or another part of the main body 14 of the prone positioning device 10 and is positioned to underlay the head of the baby 12. The tray 66 provides a surface on which objects, including a mirror 68 may be placed to focus the attention of the baby 12 while supported on the prone positioning device 10.

The adjustable frame 56 shown in FIGS. 10-17 may include a single arm 70 that is held within a bracket 72 mounted to the tray 66. The arm 70 may include a slot 73 through which a thread rod (not shown) extends to allow for extension and retraction of the arm 70. A knob 74 carried on the threaded rod may be tightened once the arm 70 is placed in the desired position. An upper end of the arm 70 may be pivotally secured to a mounting base 76 of the head rest 42. Once the head rest 42 is placed in the desired pivotal position, a knob 78 may be tightened to prevent further pivoting movement of the head rest 42. Other ways of adjustably positioning the head rest 42 are possible and are within the scope of the invention.

The groin support 40 in one embodiment may be generally cylindrical with an enlarged upper end 80 that is intended to partially overlay the legs of the baby 12. Other configurations are possible and are within the scope of the claims.

Similarly, the head rest 42 may have various configurations that are within the scope of the claims. In the embodiment shown in FIGS. 1-9, the head rest 42 is cylindrical and extends transversely so that it is intended to contact and primarily support the forehead of the baby 12. In the embodiment shown in FIGS. 10-15, the head rest 42 is U-shaped and is intended to contact the forehead and the sides of the face of the baby 12. In the embodiment shown in FIG. 16, the head rest 42 is generally rectangular in cross section and is intended to primarily contact the forehead of the baby 12. In a still further embodiment shown in FIG. 17, the head rest 42 has a split, clamshell configuration that is adjustable and is intended to contact the forehead and the sides of the face of the baby 12. It is to be understood that these are only representative examples of possible head rest 42 configurations.

When the main body 14 of the prone positioning device 10 is resting on its horizontally extending base 24, the central support region 26 may constructed so that it slopes downwardly in the direction from the front end 16 to the rear end 18 of the main body 14 so that the baby 12 is positioned with their upper torso elevated above their legs. Additionally, or alternatively, the prone positioning device 10 may include at least one adjustable support 82 that is extendable downwardly below the base 24 of the main body 14 for elevating the central support region 26 at the front end 16 of the main body 14 above or further above the central support region 26 at the rear end 18 of the main body 14.

In one embodiment shown in FIGS. 1-9, a pair of supports 82 may be pivotally mounted to the sides 20 and 22 of the main body 14. Each support 82 may comprise a shorter leg 84 that is housed within a longer leg 86. The shorter leg 84 may be pivoted downwardly from a storage position above the base 24 and releaseably locked in a deployed position extending downwardly a first distance below the base 24 to elevate the front end 16 of the main body 14 a corresponding first distance. If greater elevation is desired, the second longer leg 86 may be pivoted downwardly from the storage position above the base 24 and locked in a deployed position extending downwardly a second distance, which is greater than the first distance, below the base 24 to elevate the front end 16 a corresponding second distance. Various types of snap locks 88 or other means may be used to releaseably lock the first and second legs 84 and 86 in the storage and deployed positions.

In another embodiment best seen in FIGS. 11-15, the support 82 may extend transverse within a storage recess 90 within an open bottom of the main body 14. The support 82 may comprise an extendable, wide box-shaped leg 92 that is nested within a similar wide box-shaped structure 94 that is fixed to the main body. The leg 92 may be extended downwardly to successive deployed positions below the base 24 to successively elevate the central support region 26 at the front end 16 of the main body 14 above or further above the central support region 26 at the rear end 18 of the main body 14. Snap locks 96 or other means may be used to releaseably lock the leg 92 in the storage and deployed positions.

Figure 15:
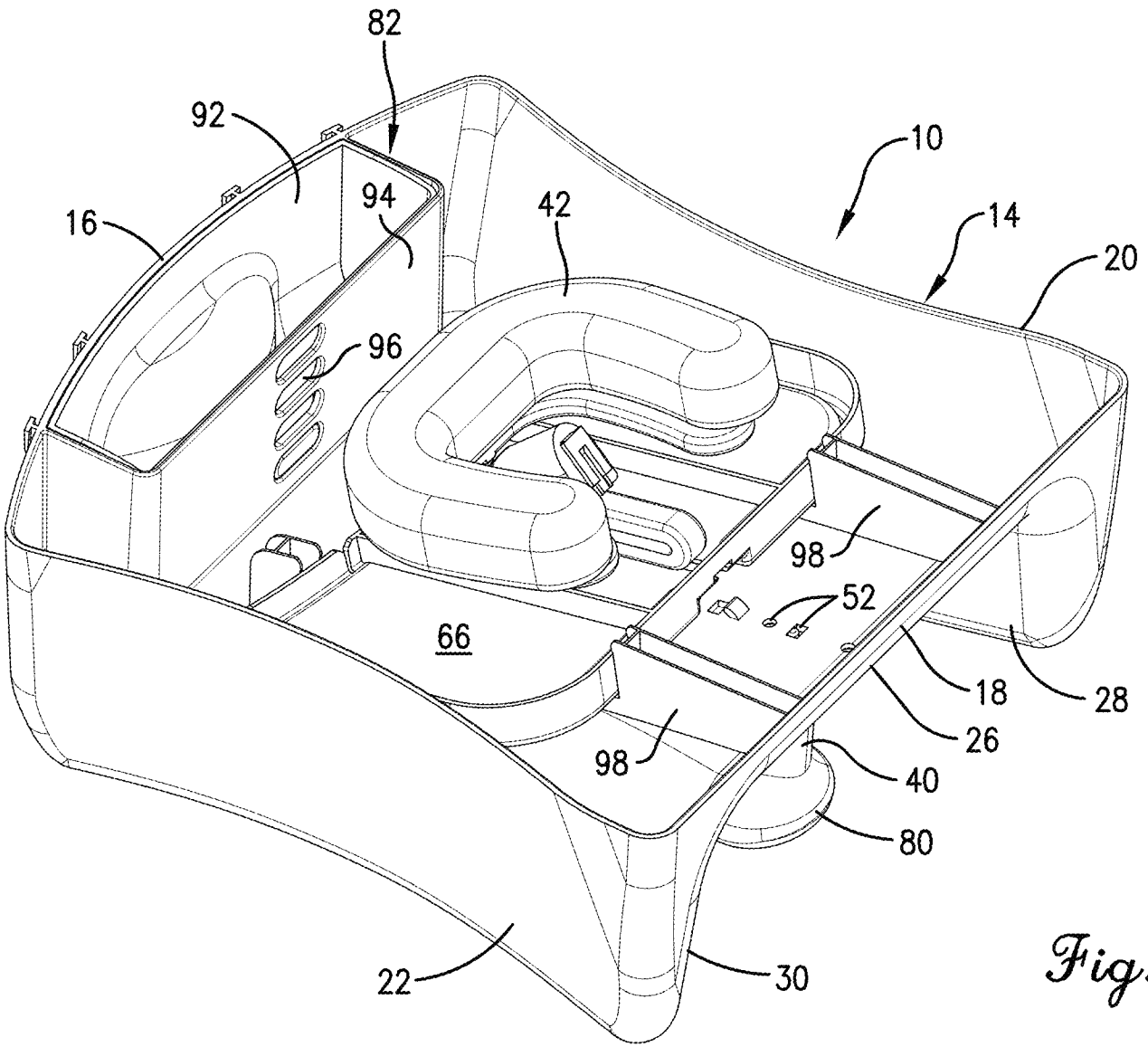
FIG. 15 is a bottom perspective view showing the second embodiment of the prone positioning device with a tray and headrest shown in a storage position under a main body of the prone positioning device.
Figure 16:
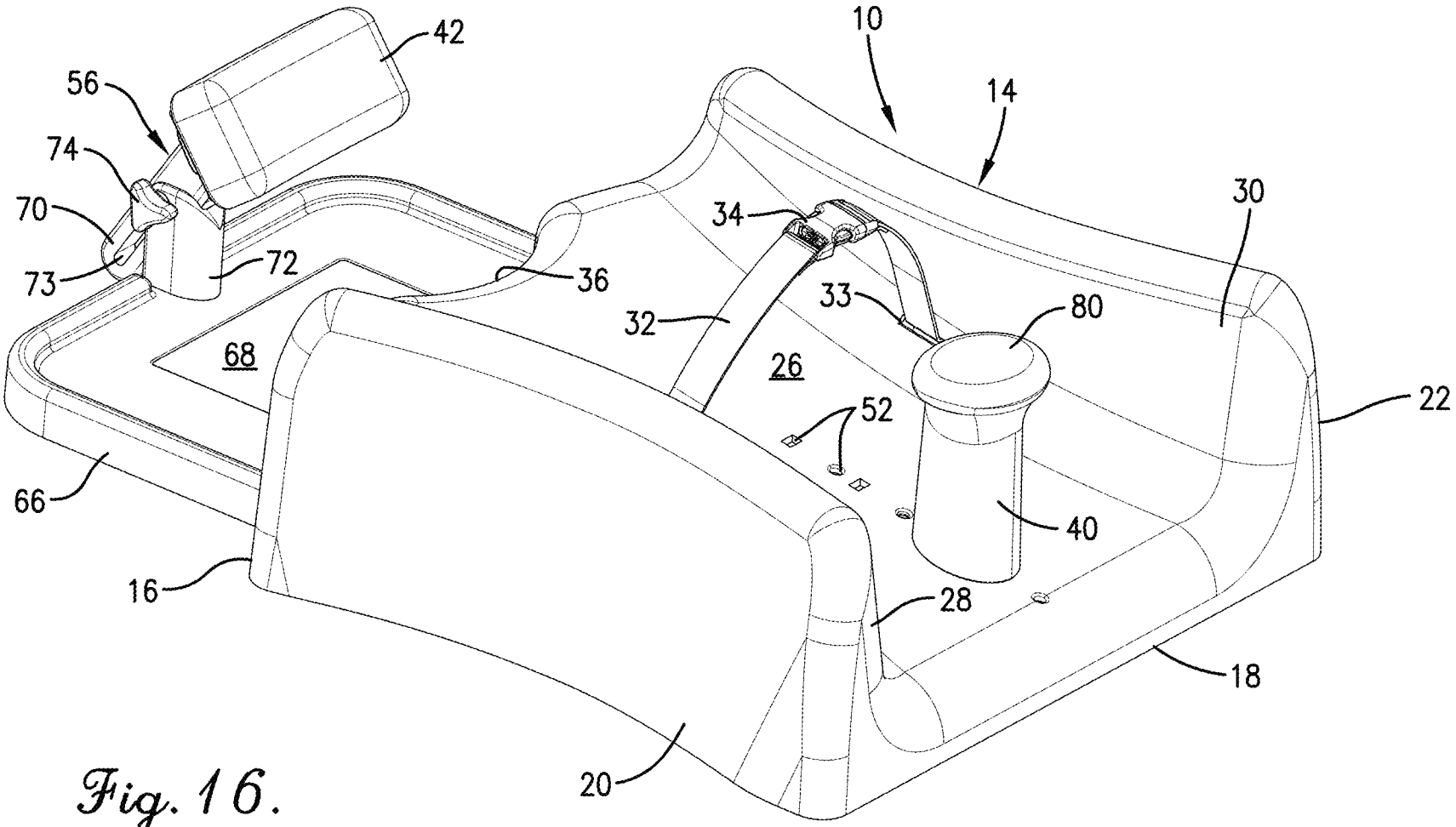
FIG. 16 is a top perspective view of a third embodiment of a prone positioning device of the present disclosure that employs a different headrest configuration from that shown in the first and second embodiments of the prone positioning device.
Figure 17:
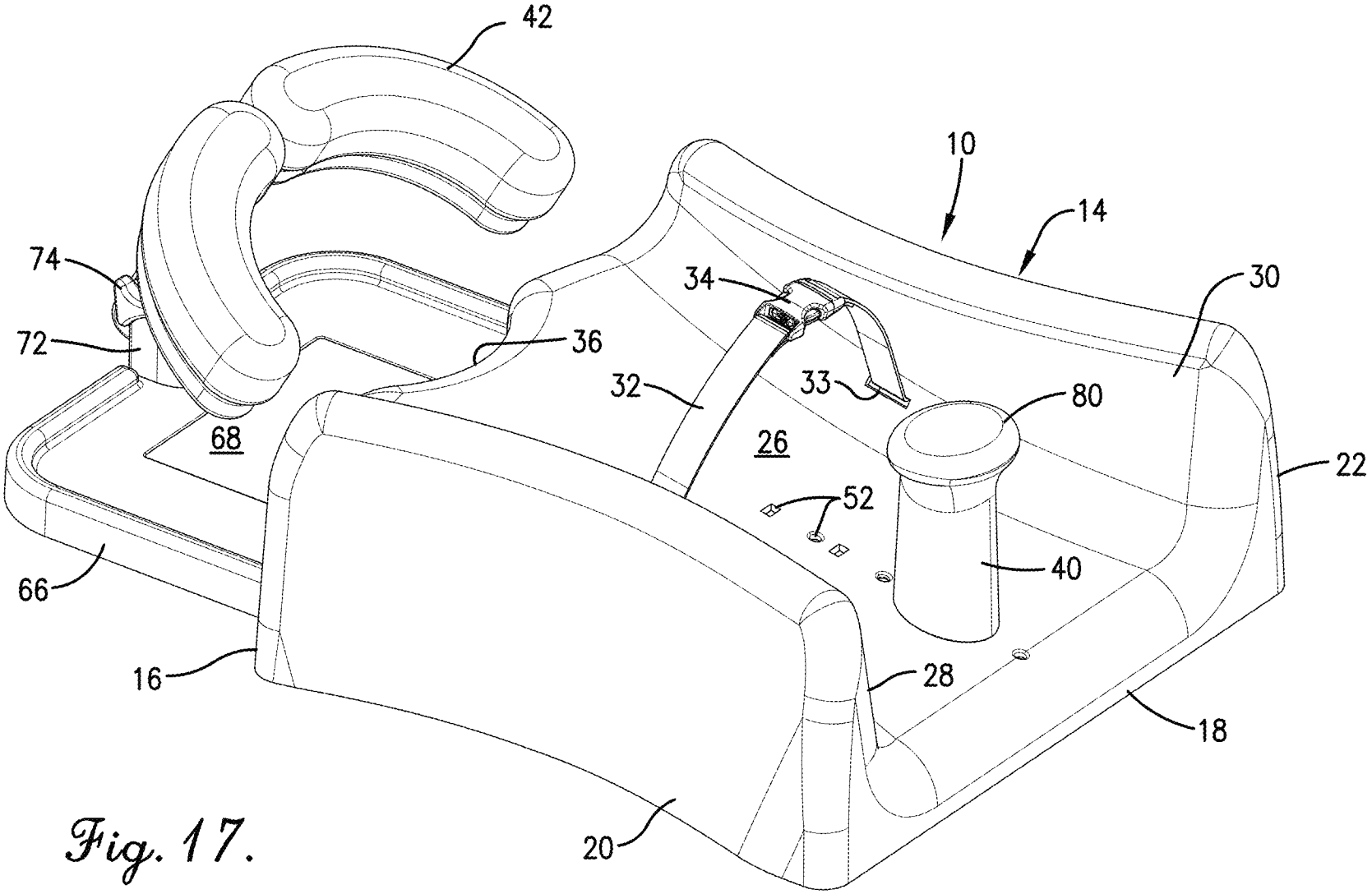
FIG. 17 is a top perspective view of a fourth embodiment of a prone positioning device that employs a further headrest configuration from that shown in the other illustrated embodiments of the prone positioning device.

In some embodiments, the tray 66 and head rest 24 are detachable to facilitate storage or shipment of the prone positioning device 10. The storage recess 90 may be constructed in a manner to releaseably secure and store the detached tray 66 and/or the detached head rest 24, such as shown in FIG. 15. In the embodiment shown in FIG. 15, storage clips 98 may secure the detached tray 66 within the storage recess 90 and the detached head rest 24 may be secured the detached tray 66 within the storage recess 90. Other means of storing the detached tray 66 and the detached head rest 23 within the storage recess 90 are possible and are within the scope of the claims.

In some embodiments, various components of the prone positioning device 10, such as the main body 14, the groin support 40, and the tray 66, may be formed using injection molding or 3-D printing. Various types of padding may be applied to some surfaces to facilitate the comfort of the baby 12 when supported by the prone positioning device 10.

It can be seen that the features of the prone positioning device 10 are well suited for providing tummy time to babies having a wide range of developmental needs, including those babies having a tracheostomy tube 38. The adjustability of the groin support 40, head rest 42, and the inclined orientation of the central support region 26 allow modifications to be made to the prone position to best suit the requirements of the baby and its development stage. The ease of use of the prone positioning device 10 also encourages and facilitates the frequency of use so that tummy time can be provided in a hospital setting and at home by caregivers other than pediatric physical therapists. The increased tummy time facilitates the development of the babies and may reduce future health care costs by decreasing the likelihood of development issues that may lead to readmission of the baby 12 to a hospital for feeding issues, face muscles problems, and swallowing challenges.

Additional Considerations

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the current technology can include a variety of combinations and/or integrations of the embodiments described herein.

In the specification and claims, reference will be made to several terms, which shall be defined to have the following meanings. The singular forms "a," "an," and "the" include plural references unless the context clearly dictates otherwise.

Although the present application sets forth a detailed description of different embodiments, it should be understood that the legal scope of the description is defined by the words of the claims and equivalent language. The detailed description is to be construed as exemplary only and does not describe every possible embodiment because describing every possible embodiment would be impractical. Numerous alternative embodiments may be implemented, using either current technology or technology developed after the filing date of this patent, which would still fall within the scope of the claims.

Throughout this specification, plural instances may implement components, operations, or structures described as a single instance. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein. The foregoing statements in this paragraph shall apply unless so stated in the description and/or except as will be readily apparent to those skilled in the art from the description.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

Although the disclosure has been described with reference to the embodiments illustrated in the attached figures, it is noted that equivalents may be employed, and substitutions made herein, without departing from the scope of the disclosure as recited in the claims.

What is claimed is:

1. A prone positioning device for a baby comprising:

a main body comprising:

spaced apart front and rear ends;

spaced apart sides;

a base for supporting the main body on a surface;

a central support region extending between the front and rear ends of the main body for supporting at least a torso of a baby;

a head rest positionable in a supported position spaced forwardly from the central support region for supporting the forehead of the baby when the torso of the baby is supported on the central support region, the head rest being supported by a pair of laterally spaced head rest support arms that extend laterally from the head rest and connect to respective spaced apart portions of the main body that are connected to the central support region; and a recess extending into the central support region from the front end toward the rear end of the main body, wherein the head rest and the recess are configured such that when the torso of the baby is supported on the central support region the area between the forehead and torso of the baby is unobstructed thereby accommodating one or more medical tubes extending downwardly from the baby's head or neck.

2. The prone positioning device of claim 1, including sidewalls at opposite sides of the central support region and extending upwardly above the central support region for sideways confining a baby within the central support region.

3. The prone positioning device of claim 1, including a groin support extending upwardly from the central support region and configured for placement between legs and against a groin of a baby supported on the central support region.

4. The prone positioning device of claim 1, including a tray extending outwardly from the front end of the main body.

5. The prone positioning device of claim 4, wherein the tray is detachable from the front end of the main body.

6. The prone positioning device of claim 4, including a storage recess under the central support region constructed for releaseably securing and storing the tray when the tray is detached from the front end of the main body.

7. The prone positioning device of claim 1, including at least one adjustable support extendable downwardly below the base of the main body for elevating the central support region at the front end of the main body above or further above the central support region at the rear end of the main body.

8. The prone positioning device of claim 1, including a head rest positionable in a supported position spaced forwardly from the front end of the main body configured for supporting the head of the baby when the baby is supported on the central support region.

9. The prone positioning device of claim 8, wherein the head rest is removable from the supported position, the pone positioning device including a storage recess under the central support region for releaseably securing and stowing the head rest in the storage recess.

10. The prone positioning device of claim 8, including a tray extending outwardly from the front end of the main body and positioned in a plane below the head rest.

11. A prone positioning device for a baby comprising:

a main body comprising:

spaced apart front and rear ends;

spaced apart sides;

a base for supporting the main body on a surface;

a central support region extending between and sloping downwardly from the front toward the rear end of the main body configured for supporting at least a torso of a baby;

sidewalls extending upwardly above the central support region at the spaced apart sides configured for sideways confining the baby within the central support region;

a head rest positionable in a supported position spaced forwardly from the central support region for supporting the forehead of the baby when the torso of the baby is supported on the central support region, the head rest being supported by a pair of laterally spaced head rest support arms that extend laterally from the head rest and connect to the sidewalls of the main body; and a recess extending into the central support region from the front end toward the rear end of the main body and configured for accommodating one or more medical tubes in a baby when the baby is supported on the central support region.

12. The prone positioning device of claim 11, including a groin support extending upwardly from the central support region and configured for placement between legs and against a groin of a baby supported on the central support region, said groin support being positionable at multiple spaced apart locations along a longitudinal midline of the central support region.

13. The prone positioning device of claim 11, including a tray extending outwardly from the front end of the main body.

14. The prone positioning device of claim 13, wherein the tray is detachable from the front end of the main body.

15. The prone positioning device of claim 14, including a storage recess under the central support region constructed for releaseably securing and storing the tray when the tray is detached from the front end of the main body.

16. The prone positioning device of claim 11, including at least one adjustable support extendable downwardly at multiple positions below the base of the main body for elevating the central support region at the front end of the main body further above the central support region at the rear end of the main body.

17. The prone positioning device of claim 11, including an adjustable head rest positionable in multiple supported positions spaced forwardly from the front end of the main body in a plane above the central support region configured for supporting a head of the baby when the baby is supported on the central support region.

18. The prone positioning device of claim 17, wherein the head rest is removable from the supported position and the storage recess is constructed for releaseably securing and stowing the head rest in the storage recess.

19. The prone positioning device of claim 17, including a tray extending outwardly from the front end of the main body and positioned in a plane below the head rest.

20. A prone positioning device for a baby comprising:

a main body comprising:

spaced apart front and rear ends;

spaced apart sides;

a base for supporting the main body on a surface;

a central support region extending between and sloping downwardly from the front toward the rear end of the main body for supporting at least a torso of a baby;

sidewalls extending upwardly above the central support region at the spaced apart sides for sideways confining a baby within the central support region;

a head rest positionable in a supported position spaced forwardly from the central support region for supporting the forehead of the baby when the torso of the baby is supported on the central support region, the head rest being supported by a pair of laterally spaced head rest support arms that extend laterally from the head rest and connect to the sidewalls of the main body; and a recess extending into the central support region from the front end toward the rear end of the main body and constructed for accommodating one or more medical tubes in a baby supported on the central support region;

a groin support extending upwardly from the central support region and configured for placement between legs and against a groin of a baby supported on the central support region, said groin support being positionable at multiple spaced apart locations along a longitudinal midline of the central support region;

a strap carried by the main body for extending over and retaining a baby on the central support region;

a tray extending outwardly from the front end of the main body and positioned in a plane below the head rest; and at least one adjustable support extendable downwardly at multiple positions below the base of the main body for elevating the central support region at the front end of the main body further above the central support region at the rear end of the main body.

21. The prone positioning device of claim 20, including a head rest carried by a frame attached to the main body for supporting a head of the baby supported on the central support region, said frame being adjustable to place the head rest in multiple supported positions spaced forwardly from the front end of the main body in a plane above the central support region.

22. The prone positioning device of claim 21, wherein the head rest is removable from the supported position, the pone positioning device including a storage recess under the central support region, the storage recess being constructed for releaseably securing and stowing the head rest under the central support region.

23. The prone positioning device of claim 20, wherein the tray is detachable from the front end of the main body and, optionally, carries a mirror that faces upwardly.

24. The prone positioning device of claim 23, including a storage recess under the central support region constructed for releaseably securing and storing the tray when the tray is detached from the front end of the main body.

* * * * *